US008096225B1

(12) United States Patent
Johnson et al.

(10) Patent No.: US 8,096,225 B1
(45) Date of Patent: Jan. 17, 2012

(54) ARMORED CAB FOR VEHICLES

(75) Inventors: Ricky Don Johnson, Katy, TX (US); Walter John Budd, Rochester, MI (US); Mike Boczek, Burlington, KY (US); Marc Russell Lappin, Cincinnati, OH (US)

(73) Assignee: BAE Systems Tactical Vehicle Systems L.P., Sealy, TX (US)

( * ) Notice: Subject to any disclaimer, the term of this patent is extended or adjusted under 35 U.S.C. 154(b) by 515 days.

(21) Appl. No.: 12/272,520

(22) Filed: Nov. 17, 2008

Related U.S. Application Data

(60) Provisional application No. 61/003,365, filed on Nov. 16, 2007.

(51) Int. Cl.
*F41H 7/02* (2006.01)
*F41H 5/14* (2006.01)
*F41H 5/02* (2006.01)

(52) U.S. Cl. ..... 89/36.08; 89/36.02; 89/36.09

(58) Field of Classification Search ..... 89/36.02, 89/36.07, 36.08, 36.09, 36.11, 36.12, 36.04; 296/187.08, 190.03, 193.07
See application file for complete search history.

(56) References Cited

U.S. PATENT DOCUMENTS

| | | | | |
|---|---|---|---|---|
| 1,002,169 | A * | 8/1911 | McSweeney | 89/40.03 |
| 1,149,127 | A * | 8/1915 | Giem | 89/40.03 |
| 2,662,793 | A * | 12/1953 | Lindsay | 296/193.07 |
| 4,215,645 | A * | 8/1980 | Moeller | 114/336 |
| 4,492,282 | A | 1/1985 | Appelblatt et al. | |
| 4,572,571 | A * | 2/1986 | Malen | 296/193.07 |
| 5,533,781 | A | 7/1996 | Williams | |
| 5,663,520 | A | 9/1997 | Ladika et al. | |
| 6,363,830 | B1 * | 4/2002 | Gonzalez | 89/36.01 |
| 6,658,984 | B2 * | 12/2003 | Zonak | 296/193.07 |
| 6,805,401 | B2 * | 10/2004 | Hayashi et al. | 296/204 |
| 6,834,912 | B2 * | 12/2004 | Cardimen et al. | 296/204 |
| 6,840,570 | B2 * | 1/2005 | Bock et al. | 296/193.07 |
| 7,195,306 | B2 * | 3/2007 | Egawa et al. | 296/187.08 |
| 7,770,506 | B2 * | 8/2010 | Johnson et al. | 89/36.09 |
| 7,836,810 | B2 * | 11/2010 | Meyer | 89/36.17 |
| 2002/0145308 | A1 | 10/2002 | Honlinger | |
| 2003/0010189 | A1 * | 1/2003 | Zonak | 89/36.08 |
| 2007/0084337 | A1 * | 4/2007 | Strassgurtl et al. | 89/36.08 |
| 2009/0058142 | A1 * | 3/2009 | Park | 296/193.07 |
| 2009/0120274 | A1 * | 5/2009 | Schneider et al. | 89/36.08 |
| 2010/0011948 | A1 * | 1/2010 | Johnson et al. | 89/36.02 |
| 2011/0168001 | A1 * | 7/2011 | Lee | 89/36.02 |

FOREIGN PATENT DOCUMENTS

| | | | |
|---|---|---|---|
| EP | 849560 | A2 * | 6/1998 |
| EP | 1566607 | | 8/2005 |

(Continued)

OTHER PUBLICATIONS

PCT International Search Report for PCT/US2008/083798.

*Primary Examiner* — Bret Hayes
*Assistant Examiner* — Joshua Freeman
(74) *Attorney, Agent, or Firm* — Wood, Herron & Evans, LLP

(57) ABSTRACT

An armored cab having at least an upper wall, two side walls, a front wall, a back wall, and a bottom wall. The armored cab and its respective walls include a longitudinal axis extending from the back wall to the front wall. The bottom wall includes at least one concave surface. The at least one concave surface faces downwardly and away from the armored cab, and is disposed in a direction substantially parallel with the longitudinal axis of the armored cab.

63 Claims, 3 Drawing Sheets

FOREIGN PATENT DOCUMENTS

| | | |
|---|---|---|
| EP | 1574812 | 9/2005 |
| WO | 02/39048 | 5/2002 |
| WO | WO 2004/053421 A1 | 12/2003 |
| WO | WO 2004/053421 | 6/2004 |

* cited by examiner

ARMORED CAB FOR VEHICLES

RELATED APPLICATIONS

This application claims the benefit of U.S. Provisional Patent Application Ser. No. 61/003,365, filed Nov. 16, 2007, and entitled Armored Cab for Vehicles.

BACKGROUND OF THE INVENTION

1. Field of the Invention

Various types of vehicles, such as joint light tactical vehicles (JLTV), tactical vehicles, or tactical trucks, and similar vehicles used in a battlefield, or other armed conflict situations, may sustain land mine strikes, or attacks from improvised explosive devices (IED), such as roadside bombs. It would be desirable for these vehicles to be able to withstand the forces of the foregoing types of attacks and explosions to enhance the survivability of the occupants of such vehicles. By armoring the cab, or passenger cabin, of a vehicle, the survivability of the occupants of the vehicle may be enhanced.

2. Description of the Related Art

It is often desirable to transport soldiers, non-military personnel, and equipment across hostile territory via motorized land vehicles such as tactical vehicles, tactical trucks, and similar vehicles. During transport, however, people occupying the cab of the vehicle are susceptible to injury from IEDs, land mines, and other bombs and explosives. To reduce injury from these encounters armor plating has been added to the cabs of such vehicles.

Without wishing to be bound by the theory, typically prior vehicle cabs were armored by increasing blast resistance through increased material strength and thickness, as well as increasing blast deflection through the use of angular and "V" shaped structures. Accordingly, the armoring of the foregoing vehicles has been achieved by using thick flat panels, or flat surfaces, of armor plate material for, or upon, the walls of the cabin, or passenger cabin.

SUMMARY OF THE INVENTION

In accordance with one embodiment of the present invention, an armored cab is provided. The cab preferably includes at least an upper wall, two side walls, a front wall, a back wall, and a bottom wall. The armored cab and its respective walls include a longitudinal axis extending from the back wall to the front wall. The bottom wall includes at least one concave surface. The at least one concave surface faces downwardly and away from the armored cab, and is disposed in a direction substantially parallel with the longitudinal axis of the armored cab.

In accordance with another embodiment of the present invention, the bottom wall of the cab further includes at least one convex surface having a convex shape. In a preferable embodiment, the concave surface and the convex surface are disposed in a direction substantially parallel with a longitudinal axis of the armored cab.

In accordance with another embodiment of the present invention, an armored cab is provided. The cab preferably includes at least an upper wall, two side walls, a front wall, a back wall, and a bottom wall. The armored cab and its respective walls include a longitudinal axis extending from the back wall to the front wall. The bottom wall includes a first and second concave surface, which face downwardly and away from the armored cab, and are disposed in a direction substantially parallel with the longitudinal axis of the armored cab. The first concave surface is disposed in alignment with a forward, or front, portion of a floor of the cab, and the second concave surface is disposed in alignment with a rearward, or rear portion of the floor of the cab. Preferably, the first and second concave surfaces are integral with the bottom wall, and centrally disposed between the at least two side walls. Continuing with the embodiment, the bottom wall further includes a first and second convex surface disposed in the direction substantially parallel with the longitudinal axis of the armored cab. The first convex surface extends along a first lower-most portion of the bottom wall, and the second convex surface extends along a second lower-most portion of the bottom wall. The first convex surface and the second convex surface are integral with the first and second lower-most portions of the bottom wall, and the first and second concave wall surfaces are disposed between the first and second convex surfaces.

For the purpose of this disclosure, geometric terms such as "circle", "sphere", "oval," and the like are used as references and for clarity of understanding, as would be understood by one of ordinary skill in the art. Accordingly, these terms should not be limited to strict Euclidean standards.

Figure 1:
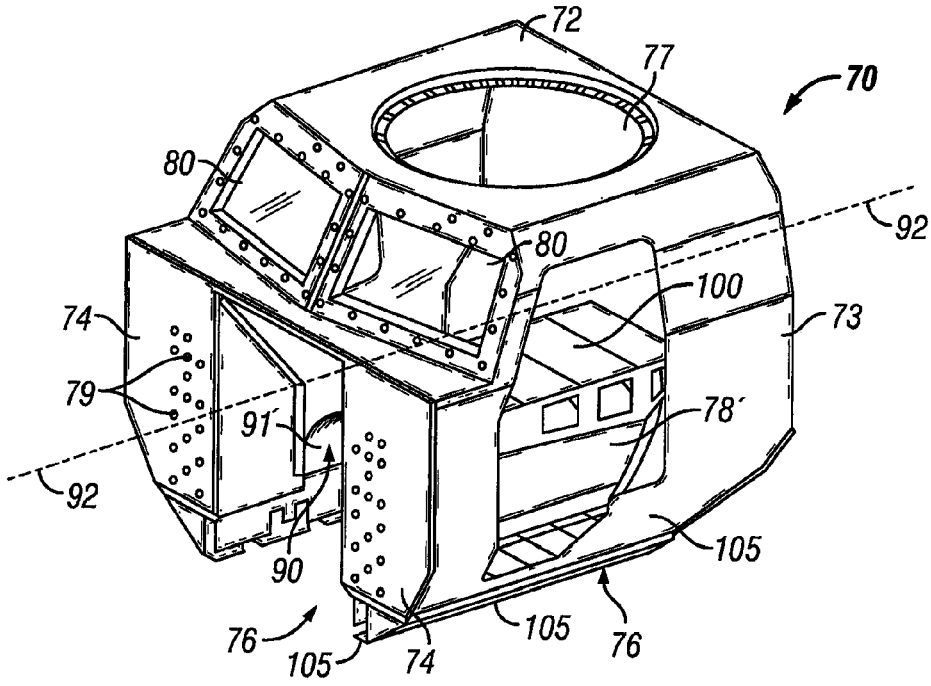
FIG. 1 is a perspective view of a portion of an armored cab, for a vehicle, such as a tactical vehicle or truck.
Figure 2:
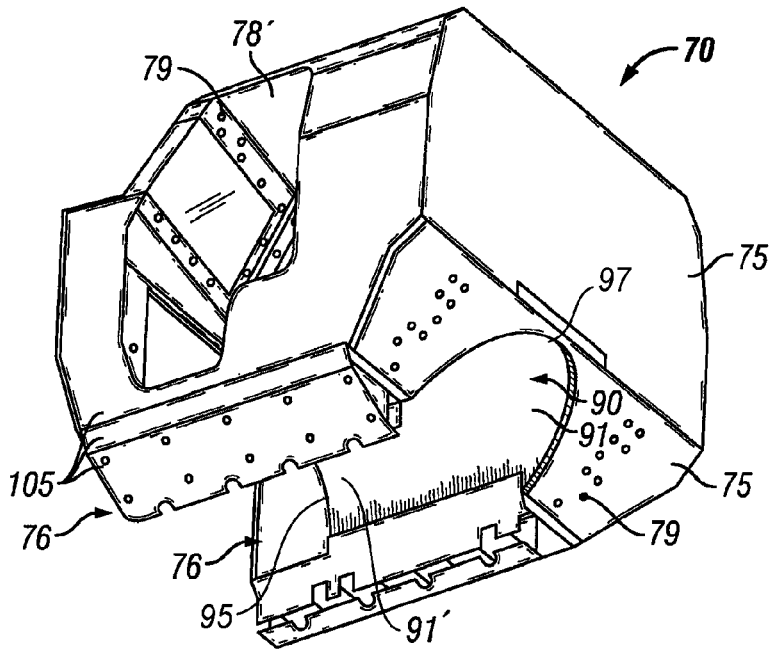
FIG. 2 is another perspective view of the armored cab of FIG. 1 looking upwardly.

While the invention will be described in connection with the certain embodiments, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION OF SPECIFIC EMBODIMENTS

With reference to FIGS. 1-4, a portion of a cab, or armored cab, 70 for use with a vehicle, such as a JLTV, tactical vehicle, truck (not completely shown), combat vehicle, cargo truck, or troop transport vehicle is shown. The cab, or armored cab, 70 generally includes: at least one upper wall, or upper wall surface, 72; preferably at least two side walls, or side wall surfaces, 73; at least one front wall, or front wall surfaces, 74; at least one back wall, or back wall surfaces, 75; and at least one floor, or bottom wall, or bottom wall surface, 76. The upper wall 72 may be provided with an opening 77 for a gun turret (not shown). At least one, and preferably two, doors 78 (shown in FIG. 4) may be provided in openings 78' in the side walls 73. The front wall surfaces 74 may be provided with at least one, and preferably two, windows 80. Preferably, the windows 80 are made from any suitable bullet-proof material which is transparent and affords the desired visibility for the occupants (not shown) of the armored cab 70, while at the same time affording protection against the explosive forces previously described.

Still with reference to FIGS. 1-4, the armored cab 70 is manufactured from materials having the requisite strength characteristics to withstand the explosive forces previously described. At least some, and preferably all, of the walls 72, 73, 74, 75, and 76 of armored cab 70, and doors 78 are made from an armor plate material, which is known as high hard steel, or armor steel, or other similar material having the requisite strength characteristics to withstand the forces encountered in a battlefield, or other type of conflict situation. Alternatively, the armor plate material may be affixed to, or riveted (using rivets 79) to, at least some, and preferably all, of the walls 72, 73, 74, 75, and 76 of armored cab 70, and doors 78. Preferably, to provide protection to the occupants of armored cab 70 against LEDs, land mine strikes, and similar explosions from beneath armored cab 70, or bottom wall surface 76 of armored cab 70 may include at least one concave surface 90.

Figure 3:
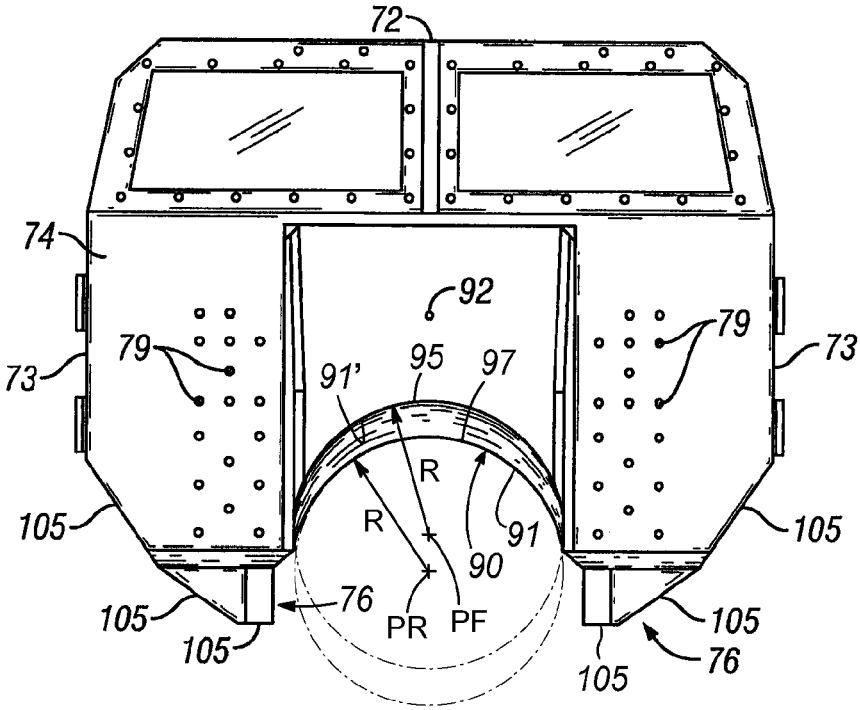
FIG. 3 is a front view of the cab of FIGS. 1 and 2.
Figure 4:
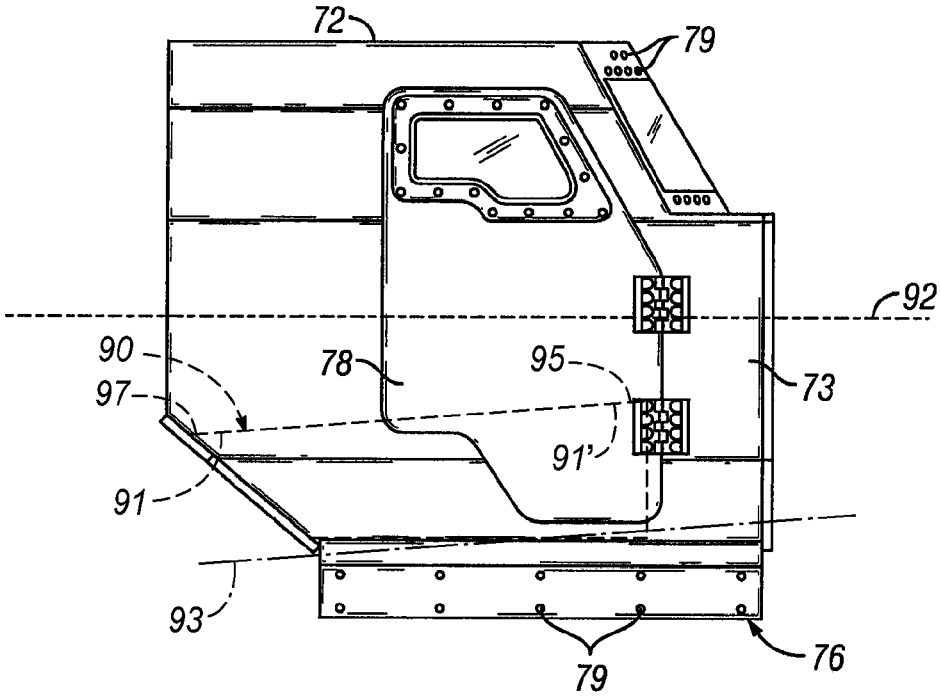
FIG. 4 is a side view of the cab of FIGS. 1-3.

Preferably, the at least one concave surface 90 is of a smooth concave shape, and thus forms an inwardly hollow rounded arch. In an embodiment, the concave surface 90 includes at least one concave wall surface 91, and is generally disposed, along a length of the cab 70, in a direction substantially parallel with the longitudinal axis 92 of cab 70. Alternatively, as shown in FIG. 3, the concave surface 90 includes a forward concave wall surface 91', and a reward concave wall surface 91. Preferably, the concave surface 90 extends substantially the entire length of the cab 70. Preferably the forward concave wall surface 91', and the reward concave wall surface 91 extend, or face, downwardly toward the ground, or roadway (not shown), and away from the cab 70. The at least one concave surface 90, the forward concave wall surface 91', and the reward concave wall surface 91, may take any arched concave shape, including spherical, oval, egg, conical, cylindrical, and the like shapes. Accordingly, the at least one concave surface 90, the forward concave wall surface 91', and the reward concave wall surface 91, may have a curvature equal to the curvature of the surface of a sphere having one particular radius. Alternatively, the surface of at least one concave surface 90, the forward concave wall surface 91', and the reward concave wall surface 91, may have a curvature equal to the curvature of the surface of a oval having two different radii.

The at least one concave surface 90 is preferably disposed substantially parallel to the longitudinal axis 92 of cab 70, and disposed substantially intermediate the side walls 73 of cab 70. In an embodiment, the at least one concave surface 90 is disposed centrally between the side walls 73, and substantially parallel to the longitudinal axis 92 of the cab 70. The at least one concave surface 90 may be disposed beneath a portion of the floor 100 of the cab 70. Alternatively, as shown in FIG. 3, a first concave wall surface 91', is disposed beneath a forward, or front portion of the floor 100 of the cab 70, and a second concave wall surface 91, is disposed beneath a rearward, or rear, portion of the floor 100 of the cab 70. The first concave wall surface 91' and the second concave wall surface 91 are preferably disposed substantially parallel with respect to each other, substantially parallel to the longitudinal axis 92 of cab 70, and substantially intermediate the side walls 73 of cab 70. In an embodiment, the at least one concave surface 90 forms the transmission tunnel of a vehicle such as a JLTV, and the like tactical vehicles.

In the illustrated embodiment of FIGS. 1-6, the concave surface 90 comprises a downwardly facing portion of a cylinder, for example approximately or about a semi-cylinder. The cylinder portion has a longitudinal axis 93. The longitudinal axis 93 of the cylinder portion lies substantially in a common vertical plane with the longitudinal axis 92 of the cab 70, and is angled slightly relative to a horizontal plane containing the longitudinal axis 92 of the cab 70. The cylinder portion has a forward end 95 and a rearward end 97. The cylinder portion is inclined such that an upper edge of the forward end 95 is positioned above an upper edge of the rearward end 97. The cylinder portion has a radius R. At the forward end 95 of the cylinder portion, the radius R is swung from a point PF, and at the rearward end 97 of the cylinder portion, the radius R is swung from a point PR. Both points PF and PR are located above a lowermost edge of the cab 70.

In the event of a mine blast or explosion of an IED beneath cab 70, the concave surface 90 contains and manages, or mitigates, the blast effects from the explosion. The concave surface 90 affords cab 70, and in particular the bottom wall surface 76, with increased structural strength which reduces dynamic and permanent deformation of the bottom wall surface 76 of the cab 70. Blast resistance is further enhanced from the strength of the armor plate material utilized for concave surface 90. If desired, the at least one concave surface 90, and/or concave wall surface 91 may be provided with locally applied stiffening ribs (not shown). Blast resistance may be further improved with generally known and specialized welding, as well as joint re-enforcement techniques.

With reference to FIGS. 1-4, armored cab 70 may include flat panels, 105 which are angularly disposed with respect to each other which also form a portion of the bottom wall surfaces 76 of cab 70. These panels assist to deflect the previously described explosive blasts.

Figure 5:
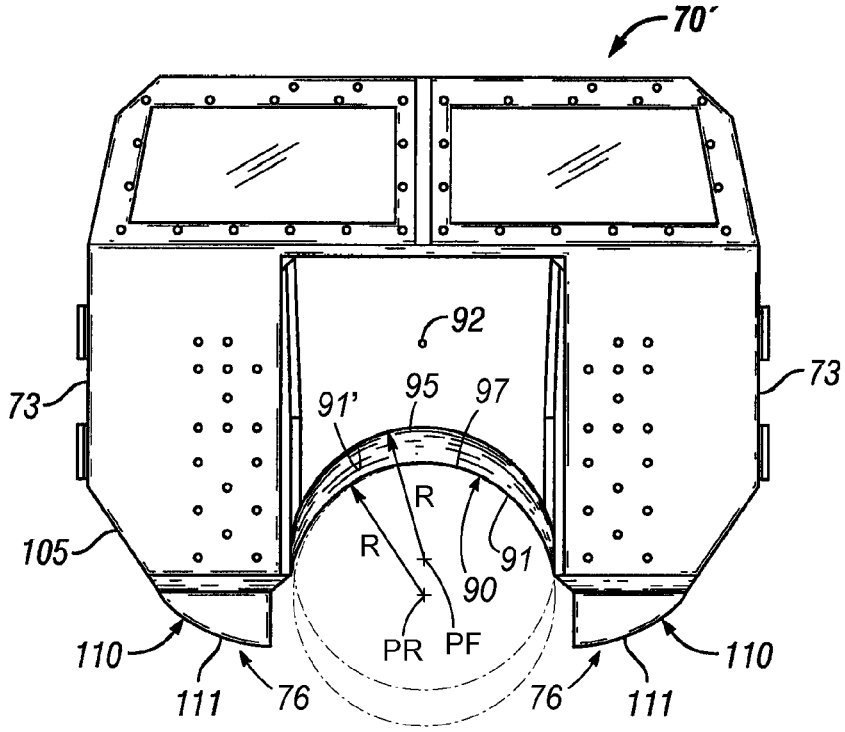
FIG. 5 is a front view of another embodiment of a portion of an armored cab, for a vehicle, such as a tactical vehicle or truck.
Figure 6:
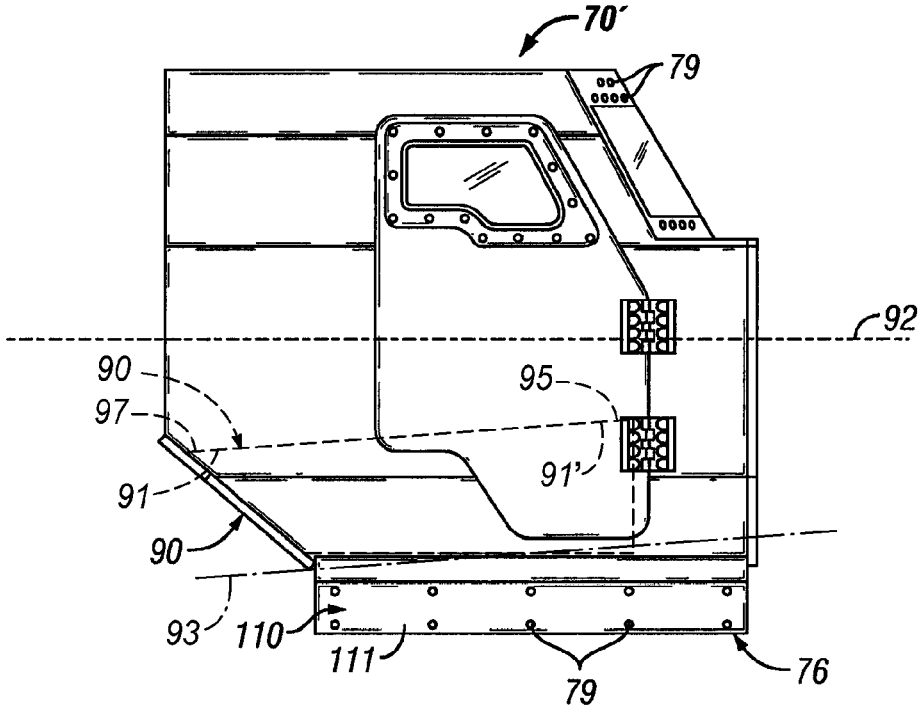
FIG. 6 is a side view of the cab of FIG. 5.

Turning now to FIGS. 5 and 6, another embodiment of a portion of an armored cab 70' is illustrated. In this embodiment, armored cab 70' not only includes at least one concave surface 90, as previously described, but also includes at least one convex surface 110. The at least one convex surface 110 preferably forms a portion of the bottom wall surface 76. The at least one convex surface 110 may take any arched convex shape, including spherical, oval, egg, conical, cylindrical, elliptical, and the like shapes. Accordingly, the surface of the at least one convex surface 110 and the at least one convex wall surface 111 may have a curvature equal to the curvature of the surface of a sphere having one particular radius. Alternatively, the surface of the at least one convex surface 110 and the at least one convex wall surface 111 may have a curvature equal to the curvature of the surface of a oval having two different radii. In an embodiment, the convex surface 110 and the at least one convex wall surface 111 have a smooth shape. In an embodiment, the at least one convex surface 110 includes at least one convex wall surface 111, which extends, along a length of the cab 70, in a direction substantially parallel to the longitudinal axis 92 of cab 70', along the lower-most portion of bottom wall surfaces 76. The convex wall surface 111 may face toward the cab 70'.

In a preferred embodiment, there are two convex wall surfaces 111, each extending substantially parallel to the longitudinal axis 92 of cab 70', along the lower-most portion of bottom wall surfaces 76. Preferably, each of the convex wall surfaces 111 extend substantially the entire length of the cab 70'. Each of the two convex wall surfaces 111 are preferably tangent with its respective flat panel 105, which is tangent with its respective side wall 73. In this embodiment, the first convex wall surface 111 is disposed beneath and exterior to the at least one concave surface 90 on a first side of the at least one concave surface 90, and the second convex wall surface 111 is disposed beneath and exterior to the at least one concave surface 90 on a second side of the concave surface 90. Preferably, the first and second sides of the at least one concave surface 90 oppose one another. In this manner, the at least one concave surface 90 is disposed between the first and second convex wall surfaces 111. These convex surfaces 110, or convex wall surfaces 111, provide blast resistance against explosive forces resulting from mine blasts and IED explosions. The structural strength from the convex surfaces 110, or convex wall surfaces 111, help reduce dynamic and permanent deformation of the bottom wall surfaces 76 of cab 70 upon encountering explosive forces. The convex surfaces 110, or convex wall surfaces 111, may be provided, if desired, with locally applied stiffening ribs (not shown). Blast resistance may be further improved with generally known and specialized welding, as well as joint re-enforcement techniques.

Specific embodiments of the present invention have been described and illustrated. It will be understood to those skilled in the art that changes and modifications may be made without departing from the spirit and scope of the inventions to be defined by the appended claims.

We claim:

1. An armored cab comprising:

at least one upper wall, at least two side walls, at least one front wall, at least one back wall, and at least one bottom wall, including a longitudinal axis extending from the at least one back wall to the at least one front wall; and the at least one bottom wall includes at least one concave surface, facing downwardly and away from the armored cab, and disposed in a direction substantially parallel with the longitudinal axis of the armored cab, the concave surface forming a transmission tunnel of the cab, the concave surface having a forward end and a rearward end, and wherein the concave surface is inclined such that an upper edge of one of the forward end and the rearward end of the concave surface is positioned above an upper edge of the other of the forward end and the rearward end of the concave surface.

2. The armored cab of claim 1, wherein the at least one upper wall, the at least two side walls, the at least one front wall, the at least one back wall, and the at least one bottom wall are formed from an armor plate material selected from the group consisting of high hard steel, armor steel, and the like.

3. The armored cab of claim 1, wherein the at least one upper wall includes an opening for a gun turret.

4. The armored cab of claim 1, wherein the at least one front wall surface further includes at least one window.

5. The armored cab of claim 4, wherein the at least one window is bullet proof and transparent.

6. The armored cab of claim 1, wherein the at least one concave surface is integral with the at least one bottom wall.

7. The armored cab of claim 1, wherein the at least one concave surface includes at least one concave wall disposed in alignment with a forward portion of a floor of the cab.

8. The armored cab of claim 1, wherein the at least one concave surface includes at least one concave wall disposed in alignment with a rearward portion of a floor of the cab.

9. The armored cab of claim 1, wherein the at least one concave surface includes a first concave wall disposed in alignment with a forward portion of a floor of the cab and a second concave wall disposed in alignment with a rearward portion of the floor of the cab.

10. The armored cab of claim 1, wherein the at least one bottom wall includes at least one convex surface.

11. The armored cab of claim 10, wherein the at least one convex surface is integral with a lowest portion of the at least one bottom wall.

12. The armored cab of claim 10, wherein the at least one convex surface is disposed in the direction substantially parallel with the longitudinal axis of the armored cab.

13. The armored cab of claim 10, wherein a first convex surface and a second convex surface are disposed in the direction substantially parallel with the longitudinal axis of the armored cab, and the first convex surface and the second convex surface extend along a first lower-most portion and a second lower-most portion of the bottom wall.

14. The armored cab of claim 13, wherein the first convex surface and the second convex surface are integral with the first and second lower-most portions of the bottom wall.

15. The armored cab of claim 14, wherein the first and second concave wall surfaces are disposed between the first and second convex surfaces.

16. The armored cab of claim 10, wherein the at least one convex surface includes at least one convex shaped wall.

17. The armored cab of claim 1 wherein the concave surface is a portion of an inner surface of a cylinder.

18. The armored cab of claim 1 wherein the concave surface is a smooth concave surface.

19. The armored cab of claim 1 wherein the upper edge of the forward end of the concave surface is positioned above the upper edge of the rearward end of the concave surface.

20. An armored cab comprising:

at least one upper wall, at least two side walls, at least one front wall, at least one back wall, and at least one bottom wall including a longitudinal axis extending from the at least one back wall to the at least one front wall;

the at least one bottom wall including:

a first concave surface facing downwardly and away from the armored cab, and disposed in a direction substantially parallel with the longitudinal axis of the armored cab, and the first concave surface disposed in alignment with a forward portion of a floor of the cab;

a second concave surface facing downwardly and away from the armored cab, and disposed in a direction substantially parallel with the longitudinal axis of the armored cab, and the second concave surface disposed in alignment with a rearward portion of the floor of the cab, wherein the first and second concave surfaces are centrally disposed between the at least two side walls, and the first and second concave surfaces are integral with the bottom wall, the first and second concave surfaces forming a transmission tunnel of the cab, the first concave surface having a forward end and the second concave surface having a rearward end, and wherein the concave surfaces are inclined such that an upper edge of one of the forward end of the first concave surface and the rearward end of the second concave surface is positioned above an upper edge of the other of the forward end of the first concave surface and the rearward end of the second concave surface;

a first convex surface disposed in the direction substantially parallel with the longitudinal axis of the armored cab, and the first convex surface extending along a first lower-most portion of the bottom wall; and a second convex surface disposed in the direction substantially parallel with the longitudinal axis of the armored cab, and the second convex surface extending along a second lower-most portion of the bottom wall, wherein the first convex surface and the second convex surface are integral with the first and second lower-most portions of the bottom wall, and the first and second concave wall surfaces are disposed between the first and second convex surfaces.

21. The armored cab of claim 20 wherein the first and second concave surfaces are a portion of an inner surface of a cylinder.

22. The armored cab of claim 20 wherein the first and second concave surfaces are smooth concave surfaces.

23. The armored cab of claim 20 wherein the upper edge of the forward end of the first concave surface is positioned above the upper edge of the rearward end of the second concave surface.

24. An armored cab comprising:

an upper wall, two opposed side walls, a front wall, a back wall, and a bottom wall, said cab having a longitudinal axis, said bottom wall comprising a downwardly facing portion of a cylinder, said cylinder having a longitudinal axis, said longitudinal axis of said cylinder lying substantially in a common vertical plane with said longitudinal axis of said cab, said longitudinal axis of said cylinder angled relative to a horizontal plane containing said longitudinal axis of said cab.

25. The armored cab of claim 24 wherein said portion of said cylinder has a forward end and a rearward end, and wherein said portion of said cylinder is inclined such that an upper edge of said forward end is positioned above an upper edge of said rearward end.

26. The armored cab of claim 25 wherein said portion of said cylinder is about semi-cylindrical.

27. The armored cab of claim 24 wherein said portion of said cylinder forms a transmission tunnel of said cab.

28. An armored cab comprising:

an upper wall, two opposed side walls, a front wall, a back wall, and a bottom wall, said cab having a longitudinal axis, said bottom wall comprising about a semi-cylinder that faces downwardly, wherein said semi-cylinder has a forward end and a rearward end, and wherein an upper edge of one of said forward end and said rearward end of said semi-cylinder is positioned above an upper edge of the other of said forward end and said rearward end of said semi-cylinder.

29. The armored cab of claim 28 wherein the upper edge of said forward end is positioned above the upper edge of said rearward end.

30. The armored cab of claim 28 wherein said semi-cylinder forms a transmission tunnel of said cab.

31. An armored cab comprising:

an upper wall, two opposed side walls, a front wall, a back wall, and a bottom wall, said cab having a longitudinal axis, said bottom wall comprising a downwardly facing portion of a cylinder, said cylinder having a radius, said radius being swung from a center point located above a lowermost edge of said cab.

32. The armored cab of claim 31 wherein said portion of said cylinder is about a semi-cylinder.

33. The armored cab of claim 32 wherein said semi-cylinder has a forward end and a rearward end, and wherein an upper edge of said forward end is positioned above an upper edge of said rearward end.

34. The armored cab of claim 31 wherein said portion of said cylinder forms a transmission tunnel of said cab.

35. The armored cab of any one of claims 24, 28, and 31, wherein said bottom wall further comprises a first pair of downwardly and inwardly extending walls and a second pair of downwardly and inwardly extending walls, each wall of said first pair of downwardly and inwardly extending walls extending downwardly from a lower edge of a respective one of said side walls and inwardly toward said longitudinal axis of said cab, each wall of said second pair of downwardly and inwardly extending walls extending downwardly from a lower edge of a respective one of said first pair of downwardly and inwardly extending walls and inwardly toward said longitudinal axis of said cab.

36. The armored cab of claim 35 wherein each of said first pair of downwardly and inwardly extending walls is planar and each of said second pair of downwardly and inwardly extending walls is planar.

37. The armored cab of claim 35 wherein each of said first pair of downwardly and inwardly extending walls is planar and each of said second pair of downwardly and inwardly extending walls is convex.

38. An armored cab comprising:

an upper wall, two side walls, a front wall, a back wall, and a bottom wall, said cab having a longitudinal axis, said bottom wall comprising a generally centrally disposed downwardly facing smooth concave wall portion extending generally parallel to said longitudinal axis of said cab and a pair of opposite laterally disposed wall portions extending generally parallel to said longitudinal axis of said cab, each of said opposite laterally disposed wall portions extending downwardly from a respective one of said side and laterally inwardly and terminating in a lowermost portion of said bottom wall on either lateral side of said concave wall portion, said concave wall portion and said opposite laterally disposed wall portions configured so as to present a substantially reduced surface area of said lowermost portions of said bottom wall in a downwardly facing direction, said concave wall portion of said bottom wall forming a power train tunnel of said cab.

39. The armored cab of claim 38 wherein said concave wall portion of said bottom wall extends substantially the entire length of said cab.

40. The armored cab of claim 38 wherein said pair of opposite laterally disposed wall portions comprises a first pair of opposite laterally disposed wall portions and a second pair of opposite laterally disposed wall portions, each of said first pair of opposite laterally disposed wall portions extending downwardly and laterally inwardly from a respective one of said side walls, each of said second pair of opposite laterally disposed wall portions extending downwardly and laterally inwardly from a respective one of said first pair of opposite laterally disposed wall portions.

41. The armored cab of claim 40 wherein each of said first pair of opposite laterally disposed wall portions is planar and each of said second pair of opposite laterally disposed wall portions is planar.

42. The armored cab of claim 40 wherein each of said first pair of opposite laterally disposed wall portions is planar and each of said second pair of opposite laterally disposed wall portions is convex.

43. The armored cab of claim 38 wherein said concave wall portion of said bottom wall is a portion of a cylinder.

44. The armored cab of claim 43 wherein said cylinder has a longitudinal axis, said longitudinal axis of said cylinder lying substantially in a common vertical plane with said longitudinal axis of said cab, said longitudinal axis of said cylinder angled relative to a horizontal plane containing said longitudinal axis of said cab.

45. The armored cab of claim 44 wherein said portion of said cylinder has a forward end and a rearward end, and wherein said portion of said cylinder is inclined such that an upper edge of said forward end is positioned above an upper edge of said rearward end.

46. The armored cab of claim 43 wherein said portion of said cylinder is about a semi-cylinder.

47. The armored cab of claim 43 wherein said cylinder has a radius, said radius being swung from a center point located above a lowermost edge of said cab.

48. The armored cab of claim 38 wherein each of said pair of opposite laterally disposed wall portions is planar.

49. The armored cab of claim 38 wherein said bottom wall further includes a front end wall and a rear end wall, said front end wall substantially perpendicular to said longitudinal axis of said cab, said rear end wall angled relative to said longitudinal axis of said cab such that a lower edge of said rear end wall is located forward of an upper edge of said rear end wall.

50. The armored cab of claim 49 wherein said front end wall and said rear end wall are planar.

51. The armored cab of claim 38 wherein said pair of opposite laterally disposed wall portions of said bottom wall extend substantially the entire length of said cab.

52. An armored cab comprising:

a top wall, two side walls, a front wall, a back wall, and a bottom wall, said cab having a longitudinal axis, said bottom wall comprising a generally centrally disposed downwardly facing smooth concave wall portion, extending substantially an entire length of said cab and generally parallel to said longitudinal axis of said cab, and a pair of opposite laterally disposed wall portions extending substantially the entire length of said cab and generally parallel to said longitudinal axis of said cab, each of said opposite laterally disposed wall portions extending downwardly and laterally inwardly and terminating in a lowermost portion of said bottom wall on either lateral side of said concave wall portion, said concave wall portion and said opposite laterally disposed wall portions configured so as to present a substantially reduced surface area of said lowermost portions of said bottom wall in a downwardly facing direction;

said concave wall portion of said bottom wall forming a power train tunnel of said cab.

53. The armored cab of claim 52 wherein each of said pair of opposite laterally disposed wall portions is planar.

54. The armored cab of claim 52 wherein said pair of opposite laterally disposed wall portions comprises a first pair of opposite laterally disposed wall portions and a second pair of opposite laterally disposed wall portions, each of said first pair of opposite laterally disposed wall portions extending downwardly and laterally inwardly from a respective one of said side walls, each of said second pair of opposite laterally disposed wall portions extending downwardly and laterally inwardly from a respective one of said first pair of opposite laterally disposed wall portions.

55. The armored cab of claim 54 wherein each of said first pair of opposite laterally disposed wall portions is planar and each of said second pair of opposite laterally disposed wall portions is planar.

56. The armored cab of claim 54 wherein each of said first pair of opposite laterally disposed wall portions is planar and each of said second pair of opposite laterally disposed wall portions is convex.

57. The armored cab of claim 52 wherein said concave wall portion of said bottom wall is a portion of a cylinder.

58. The armored cab of claim 57 wherein said cylinder has a longitudinal axis, said longitudinal axis of said cylinder lying substantially in a common vertical plane with said longitudinal axis of said cab, said longitudinal axis of said cylinder angled relative to a horizontal plane containing said longitudinal axis of said cab.

59. The armored cab of claim 58 wherein said portion of said cylinder has a forward end and a rearward end, and wherein said portion of said cylinder is inclined such that an upper edge of said forward end is positioned above an upper edge of said rearward end.

60. The armored cab of claim 57 wherein said portion of said cylinder is about a semi-cylinder.

61. The armored cab of claim 57 wherein said cylinder has a radius, said radius being swung from a center point located above a lowermost edge of said cab.

62. The armored cab of claim 52 wherein said bottom wall further includes a front end wall and a rear end wall, said front end wall substantially perpendicular to said longitudinal axis of said cab, said rear end wall angled relative to said longitudinal axis of said cab such that a lower edge of said rear end wall is located forward of an upper edge of said rear end wall.

63. The armored cab of claim 62 wherein said front end wall and said rear end wall are planar.

* * * * *

UNITED STATES PATENT AND TRADEMARK OFFICE

CERTIFICATE OF CORRECTION

PATENT NO. : 8,096,225 B1
APPLICATION NO. : 12/272520
DATED : January 17, 2012
INVENTOR(S) : Ricky Don Johnson et al.

It is certified that error appears in the above-identified patent and that said Letters Patent is hereby corrected as shown below:

Claim 38, column 8, lines 21-22 read "posed wall portions extending downwardly from a respective one of said side and laterally inwardly and"; they should read --posed wall portions extending downwardly and laterally inwardly and--.

Signed and Sealed this
Twenty-eighth Day of February, 2012

David J. Kappos

David J. Kappos
*Director of the United States Patent and Trademark Office*